US006827126B2

(12) United States Patent
Niimi et al.

(10) Patent No.: US 6,827,126 B2
(45) Date of Patent: Dec. 7, 2004

(54) METAL DIE DEVICE FOR CASTING

(75) Inventors: Tomio Niimi, Toyota (JP); Yoshimasa Sawada, Toyota (JP); Kouichi Itou, Toyota (JP); Tomohiko Kokubo, Toyota (JP)

(73) Assignee: Aisin Takaoka Co., Ltd., Toyota (JP)

( * ) Notice: Subject to any disclaimer, the term of this patent is extended or adjusted under 35 U.S.C. 154(b) by 159 days.

(21) Appl. No.: 10/360,981

(22) Filed: Feb. 7, 2003

(65) Prior Publication Data

US 2003/0155096 A1 Aug. 21, 2003

(30) Foreign Application Priority Data

Feb. 18, 2002 (JP) ..... 2002-039559

(51) Int. Cl.[7] ..... B22D 33/04; B22D 17/04
(52) U.S. Cl. ..... 164/340; 164/346; 164/351
(58) Field of Search ..... 164/340, 341, 164/342, 343, 346, 351, 365, 369

(56) References Cited

U.S. PATENT DOCUMENTS 5,323,840 A * 6/1994 Usui et al. ..... 164/332
5,887,643 A * 3/1999 Nakamura et al. ..... 164/340

FOREIGN PATENT DOCUMENTS

JP P2000-024769 A 7/1998

* cited by examiner

*Primary Examiner*—Kiley S. Stoner
*Assistant Examiner*—Len Tran
(74) *Attorney, Agent, or Firm*—Welsh & Katz, Ltd.

(57) ABSTRACT

A metal die device for casting of a simpler device structure by which a cast product having an undercut may directly be produced is disclosed. A casting (cavity) S is provided between a fixed die 21 and a movable die 31 as a movable core 40 having an undercut forming projection 41 is interposed between the fixed and movable dies. A swing member 54, caused to swing by a cylinder 51, is provided overlying the movable die 31. On the swing member 54, there is provided a cylinder 57 for vertically sliding the core 40. In die opening, following casting, the core 40 is vertically slid and subsequently caused to swing towards an upper outer side to release the core 40 from the cast product. Degree of freedom in metal designing is achieved without excess restriction in the shape or position of the undercut.

18 Claims, 4 Drawing Sheets

METAL DIE DEVICE FOR CASTING

FIELD OF THE INVENTION

This invention relates to a metal casting (or molding) device for forming a cast product having an undercut.

BACKGROUND OF THE INVENTION

Heretofore, in preparing a product having an undercut (inner cut-out configuration) by die casting (die cast molding), it has been necessary to use a collapsible core, such as a salt core, at the time of die casting, or to apply post-processing, such as cutting off unneeded bulk portions from a die cast product. However, these conventional techniques suffer from a drawback such as increased cost or an increased number of steps. Thus, in JP Patent Kokai JP-P2000-24769A, for example, a die casting method has been proposed in which an ejection member (movable core member) operating in association with an ejection pin is used to form an undercut simultaneously with molding.

In the die casting method, disclosed in the publication of JP Patent Kokai JP-P2000-24769A, an ejection member for forming an undercut is provided in a portion (inner portion) of a movable core (that is a core loaded on a movable die). This ejection member is adapted to be movable along a direction of ejection of an ejection pin, that is, in the horizontal direction. Using the movable core and the ejection member as one unit, a cast product presenting an undercut is formed in a cavity provided between the fixed die and the movable die. In taking out the cast product out of the metal die device, the dies are first opened, and the ejection member and the ejection pin are then pushed out towards a fixed die to disengage the cast product and a runner continuing thereto momentarily from the movable die and the movable core. Then, the runner is gripped by a robot catch and the cast product and moved in a transverse direction (in a direction perpendicular to the direction of movement of the movable die, that is, in a vertical direction) along with the runner to disengage the cast product ultimately from the ejection member.

However, the above-identified die casting method, disclosed in JP Patent Kokai JP-P2000-24769A, has a number of deficiencies. First, it is necessary to provide the ejection member, which is movable in the horizontal direction in synchronism with the extruding operations of the ejection pin, within the inside of the movable core. Moreover, since a robot catch mechanism needs to be provided between the fixed and movable dies following the mold opening, the metal die device is of a complex and bulky structure.

Second, in the above-mentioned die casting method, it is mandatory to use a metal die device of such a structure in which an ejection member for forming an undercut is protruded from within the movable core towards the fixed die in synchronism with the extruding operation of the ejection pin provided on the movable die. If this metal die device is used, there is caused no significant inconvenience when such an undercut in the cast product is produced in which the undercut in the cast product is opened towards the movable die. However, if, with the use of the same method and device, such an undercut of the cast product is to be formed which is opened towards the fixed die, with the portion of the cast product subjected to severe shrinkage, that is the portion of the cast product subjected to relatively large rapping resistance upon removal from the die, lying on the fixed die side, such a phenomenon in which the cast product becomes adhered to the fixed die at the time of die opening (so-called sticking) tends to be produced. Should this sticking occur, it becomes difficult to disengage the cast product from the metal die device. In addition, the useful life of the metal die tends to be shortened. That is, in the above-mentioned conventional die casting method, considerable constraint may be imposed on the casting conditions in the metal die device, depending on the position or shape of the undercut in the cast product, with the consequence that the degree of freedom in designing the metal die is reduced.

BRIEF DESCRIPTION OF THE DRAWINGS

The benefits and advantages of the present invention will become more readily apparent to those of ordinary skill in the relevant art after reviewing the following detailed description and accompanying drawings wherein.

DETAILED DESCRIPTION OF THE INVENTION

Figure 1:
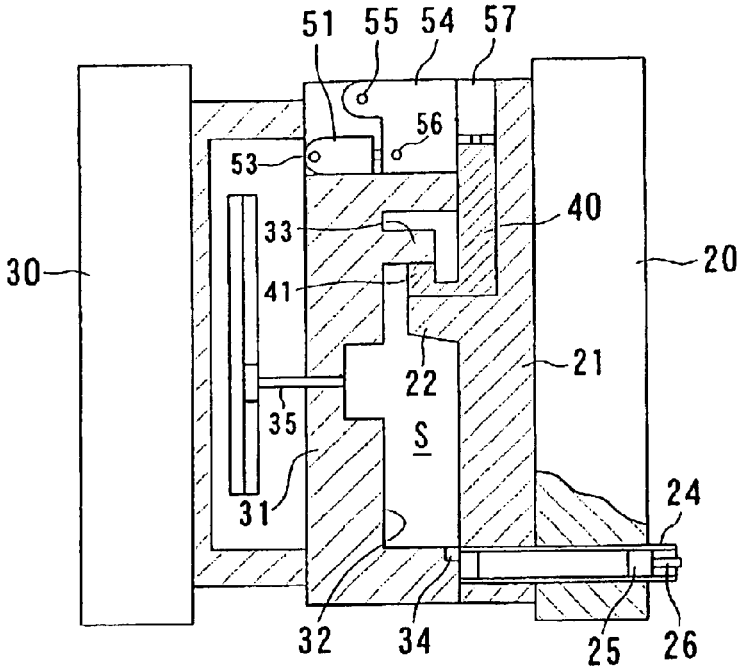
FIG. 1 is a cross-sectional view of an embodiment of a metal die device for casting at the time of mold closure.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, not should be inferred to the limit of the subject matter disclosed herein.

All patents referred to herein, are hereby incorporated herein by reference, whether or not specifically to do so within the text of this disclosure.

In the present disclosure, the words "a" or "an" are to be taken to include both the singular and the plural. Conversely, any reference to plural items shall, where appropriate, include the singular.

The present invention is generally aimed at to overcome the deficiency of the aforementioned current state of the art. It is an object of the present invention to provide a metal die device for casting in which a cast product having an undercut may be formed directly with a simpler device structure. It is another object of the present invention to provide a metal die device for forming in which it is possible to keep the degree of freedom in the metal die designing without excessively restricting the casting conditions in the metal die device by the position or shape of the undercut in the cast product.

The subject-matter of a first aspect is directed to a metal die device for forming a cast product having an undercut which comprises first and second dies for being moved towards and away from each other, with the dies defining a casting space therein when closed, a core having an undercut forming projection, and a core driving mechanism for sliding the core in a direction substantially perpendicular to the direction of movement of the first and second dies towards and away from each other and for causing the core to swing towards outside from between the first and second dies as the first and second dies are in a state separated from each other, wherein a cast product is produced under the state that the undercut forming projection of the core is arranged in the casting space, and wherein the core is caused to slide and swing by the core driving mechanism at the time of opening the first and second dies to separate the core from the cast product and to enable the cast product to be dismounted from one of the dies.

With this metal die device for casting, the first and second dies are abutted (and assembled) to each other with the core interposed there between, whereby die closure is allowed to occur under the condition that at least the undercut forming projection of the core is located within a casting space defined within the first and second dies. If, after the cast product has been formed in the casting space defined within the two dies, the dies are opened, the cast product and the core, fitted to each other, appear in the state that the core is affixed to one of the dies. By causing the core to be slid by the core driving mechanism in a direction substantially perpendicular to the direction of movement of the two dies towards and away from each other, at least the undercut forming projection is disengaged from a portion of the cast product, that is from a site thereof which later becomes an undercut, whereby the cast product and the core are disengaged from each other. By the core driving mechanism causing the core to swing towards outside from (a space) between the first and second dies, which are in the state separated from each other, the core is receded outwards from between the dies, to enable the cast product to be dismounted from the die to which the cast product has so far been affixed. According to the present invention, a cast product having the undercut may be directly cast by a metal die device for casting a die-cast product which is of a relatively simplified structure.

According to a second aspect the metal die device as mentioned at the first aspect, has the following feature: The core driving mechanism includes a slide mechanism operatively connected to the core for causing the core to slide in a direction substantially perpendicular to the direction of movement of the first and second dies towards and away from each other, and a swing mechanism operatively connected to the slide mechanism for causing the core and the slide mechanism to swing towards outside from between the first and second dies which are in the state separated from each other.

With this metal die device for casting, the core driving mechanism is made up by a slide mechanism for sliding the core in a specified direction, and a swing mechanism operatively connected to the slide mechanism for causing the swinging of the core and the slide mechanism. That is, the core having the undercut forming projection is operatively connected to the swing mechanism via the slide mechanism. With this core driving mechanism, including the slide mechanism and the swing mechanism, operatively connected and unified together, the arrangement of the metal die device for casting, provided with the movable core, may be simplified as compared to a conventional arrangement, exemplified by JP Patent Kokai JP-P2000-24769A in which an ejection mechanism for horizontally sliding the ejection member is independent from a robot catch mechanism adapted for vertically disengaging the cast product from the ejection member.

According to a third aspect, the metal die device has the following features: The first die is a fixed die, the second die is a movable die, and the movable die as the second die is provided with the core and with the core driving mechanism, and wherein the movable die is provided with an ejection mechanism for ejecting the cast product affixed to the movable die towards the fixed die at the time of die opening for releasing the cast product affixed to the movable die therefrom.

With this metal die device for casting, in which the core having the undercut forming projection and the core driving mechanism are provided to the movable die, the cast article, produced in the casting space, is embraced or hugged towards the movable die by the core fitted in the casting space at the time of casting following the die closure. The result is that, when the movable die is spaced apart from the fixed die on a die opening following the casting, the cast product in its movement follows the movable die along with the core. That is, there is no risk of the cast product sticking to the fixed die. Thus, it becomes possible to assure the degree of freedom of metal die designing without the casting conditions in the metal die device being excessively restricted by the position or shape of the undercut in the cast product desired. In particular, even if an undercut opened to the fixed die is desired to be produced and hence the portion of the cast product subjected to severe shrinkage is on the fixed die side, there is no risk of the cast product sticking to the fixed die. According to the present invention, since the cast product is affixed at all times to the movable die on die opening, the cast product can be smoothly released from the movable die by the ejection mechanism after retreating the core to outside of the spacing between the dies by the core driving mechanism. Since there is no fear of the cast product sticking to the fixed die, the useful life of the metal die device can be prolonged.

According to a fourth aspect, the metal die device has a further feature as follows: During casting following die closure and directly after die opening, the core is located at a position for clamping the cast product between the core and the movable die.

With this arrangement, when the movable die is moved away from the fixed die, the cast product is embraced to the movable die device by the core provided to the movable die, so that the cast product is necessarily affixed to the movable die and hence the sticking of the cast product to the fixed die is prevented from occurring. Meanwhile, after completion of die opening, the core is caused to slide and swing by the core driving mechanism, so that, after disengaging the core from the cast product, the cast product may be dismounted by the ejection mechanism from the movable die.

According to a fifth aspect, the metal die device has a further feature as follows: The fixed die as the first die includes a recess forming projection for forming in the cast product a recess which is opened to the fixed die and which communicates with the undercut, and when the movable die is separated away from the fixed die, the recess provided to the cast product by the recess forming projection of the fixed die allows for release from the cast product of the undercut forming projection as the core is slid by the core driving mechanism.

With this arrangement, when the movable die is moved away from the fixed die after casting the product in the casting cavity, the recess forming projection of the fixed die is disengaged from a portion of the cast product affixed to the movable die, so that there is produced a recess opening toward the fixed die as a void space so far occupied by the projection. Since this recess is destined to communicate with the undercut in the cast product, there is furnished a space within which at least the undercut forming projection of the core may be slid in a direction substantially perpendicular to the direction of relative movement of the dies towards and away from each other. By the appearance of the recess as the space allowing for sliding, the core can be slid in the direction substantially perpendicular to the direction of relative movement of the fixed and movable dies, so that it becomes possible to smoothly release the undercut forming projection of the core from a portion of the cast product on the movable die, that is the site of the cast product where the undercut is to be formed.

Referring to the drawings, an embodiment of a metal die device for forming is explained in detail. The present embodiment is directed to an instance of die casting a product (cast product 10) shown in FIGS. 7A and 7B. This cast product 10 is substantially disc-shaped and has, in its inside, a recess 11*a*, opened in an upper surface 11, a recess 12*a*, opened in a lower surface 12, and an undercut 13. This undercut 13 is a cut-out like an inner communication through-hole interconnecting the recesses 11*a* and 12*a* along the radial direction of the cast product. In the conventional technique, this undercut was formed using a collapsible core.

Referring to FIGS. 1 to 6, a metal die device includes a fixed platen 20, a movable platen (plate member) 30, a fixed die 21, as a first die, provided on the fixed platen 20 and a movable die 31, as a second die, mounted on the movable platen 30. The movable platen 30 and the movable die 31 are movable towards and away from the fixed die 21 by a driving mechanism, not shown.

In a casting space forming surface of the fixed die 21, there is formed a recess forming projection 22 which performs the role of forming a lower surface recess 12*a* of a cast product 10. In the movable die 31, there are formed a casting cavity 32, which performs the role of forming the upper surface shape and the outer peripheral surface shape of the cast product 10, and a recess forming projection 33, which performs the role of forming the upper surface recess 11*a* of the cast product 10. A casting space forming surface of the movable die 31 is defined by the surfaces of the cavity 32 and the projection 33. By joining the dies 21, 31, with a movable core 40 interposed between the fixed die 21 and the movable die 31, as shown in FIG. 1, there is reliably formed in the metal die device a sole (unitary) casting space S (so-called cavity) having an inner shape consistent with the shape of the targeted cast product 10.

Meanwhile, the distal end (lower end in FIG. 1) of the movable core 40 is substantially of an L-shaped cross-section and the foremost part of the distal end is formed with an undercut forming projection 41 matched to the shape of the undercut 13 to be provided to the cast product 10.

In the vicinity of the lower end of the fixed (stationary) platen 20 and the fixed (stationary) die 21, there is provided a mechanism for forcing molten metal as a casting material into a casting space S. This forcing mechanism is made up by a sleeve 24, a plunger head member 25 slidable within the sleeve 24, and an injection rod 26. In the junction surface of the movable die 31, there is formed a groove 34 communicating with the sleeve 24. This groove 34 operates as a gate for forwarding the casting material in the sleeve 24 into the casting space S at the time of tight joining of the movable die 31 and the fixed die 21 (die closure).

Referring to FIGS. 1 to 6, there is provided in an upper region of the movable die 31 a core driving mechanism for holding and driving the movable core 40. This core driving mechanism is made up by a swing cylinder 51, a swing member 54 and a slide cylinder 57.

The swing cylinder 51 includes a piston (rod) 52 which appears and disappears (see FIGS. 5 and 6) and which is mounted for rotation relative to the movable die 31 about a supporting pin (pivot) 53 as a center of rotation. The swing member 54 is mounted for rotation relative to the movable die 31 about a supporting pin (pivot) 55 as a center of rotation. A connection pin 56 is provided to a portion of the swing member 54 which is at a preset distance from the supporting pin 55. The swing member 54 is pivotably connected through this connection pin 56 to the distal end of the piston (rod) 52 of the swing cylinder 51. The swing member 54 is caused to swing about the supporting pin 55 as the center of rotation by a distance (d) between the connecting pin 56 and the supporting pin 53 being changed (to d') responsive to the appearing and disappearing operation of the piston (rod) 52 of the swing cylinder. A slide cylinder 57 is secured to the swing member 54. The slide cylinder 57 is provided with a piston rod 58 that appears and disappears (see FIGS. 3 and 4). The movable core 40 is secured to the distal end of the piston rod 58. That is, the movable core 40 is slidable responsive to the appearing and disappearing (projecting and retracting) operation of the piston rod 58 of the slide cylinder 57.

The appearing and disappearing operation of the piston rod 58 of the slide cylinder 57 occurs as the slide cylinder 57 is arranged vertically along the plumb line direction. Consequently, the slide cylinder 57 is equivalent to a "slide mechanism operatively connected to the core 40 in order to permit the core 40 to be slid in a direction approximately perpendicular to the direction in which the fixed die 21 and the movable die 31 are moved towards and away from each other". On the other hand, the swing cylinder 51 and the swing member 54 are equivalent to a "swing mechanism operatively connected to the slide mechanism to permit the core 40 and the slide mechanism to swing towards outside from a space between the fixed die 21 and the movable die 31 lying in a state separated from each other".

Within and in the rear side of the movable die 31, there is provided an ejection mechanism provided with plural ejection pins 35. In each drawing, there is shown only one such ejection pin. The ejection pins 35 are adapted to appear in and disappear from the casting cavity 32 by a driving mechanism, not shown. This ejection mechanism serves for ejecting and dismounting the cast product 10 held in the casting cavity 32 from the cavity 32 after separating the movable die 31 from the fixed die 21 following charging the material into the casting space (cavity) S.

The method of using this casting metal die device is now explained.

In starting the die casting, the piston (rod) 52 of the swing cylinder 51 and the piston (rod) 58 of the slide cylinder 57 are both receded, as shown in FIG. 1, whereby the main body portion of the movable core 40 is caused to approach towards the movable die 31 and positioned vertically along the plumb line direction, at the same time as the undercut forming projection 41 of the core 40 is brought into contact with a lateral surface of the recess forming projection 33 of the movable die 31. In this state, the movable platen 30 and the movable die 31 are moved towards the fixed die 21 join the movable die 31 with the fixed die 21. By this joining, the casting space S is defined within the metal die device, by the two casting recesses 22, 32, so that die closure operation as the core 40 is interposed between both the dies 21, 31 comes to a close.

Figure 2:
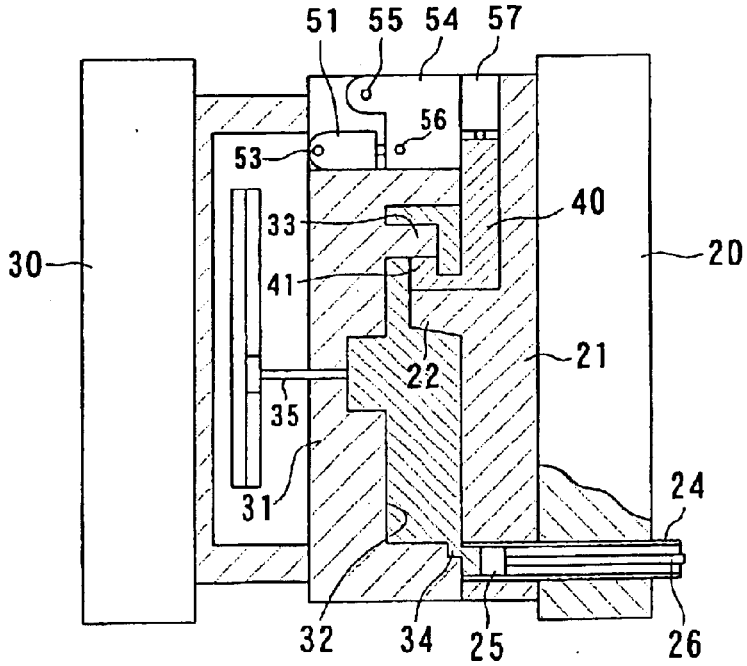
FIG. 2 is a cross-sectional view of the metal die device for casting at the time of charging molten metal.

After the die closure, the casting material charged into sleeve 24 is forced into the casting space S through the charging groove 34 (gate) by the plunger head 25 and the injection rod 26, as shown in FIG. 2. This completes the die casting of the cast product 10 in the casting space S. The movable die 31 then is moved away from the fixed die 21, whereby the cast product 10 held by the movable die 31 is also separated simultaneously away from the fixed die 21.

The reason the cast product 10 follows up with the movable die 31 in the die opening is partly that the shapes of the dies 21, 31 are designed so that the die-removal resistance from the movable die 31 is higher than that from the fixed die 21 and partly and possibly with higher probability that the movable core 40 is arranged at a position of embracing the cast product 10 between the core 40 and the movable die 31, such that the core 40 embraces the cast product 10 towards the movable die 31. Stated differently, even if the shapes of the dies 21, 31 are designed so that die-removal resistance from the movable die 31 is smaller than that from the fixed die 21, the cast product 10 necessarily follows the movable die 31 on the die opening, under the cast product embracing action by the movable core 40, without the cast product 10 sticking to the fixed die 21.

The cast product 10 immediately after the die opening is formed as one with a runner 14 which is formed on solidification of the casting material which has been charged in the charging groove 34 and the distal end region of the sleeve 24. Upon die opening, there is formed a space so far occupied by the recess forming projection 22 of the fixed die 21, in a portion of the cast product 10, directly below the movable core 40. This space later is to be the recess 12*a* in the cast product 10. By this space, now presented, downward sliding of the movable core 40, that is release of the undercut forming projection 41 from the cast product 10, is allowed.

Figure 4:
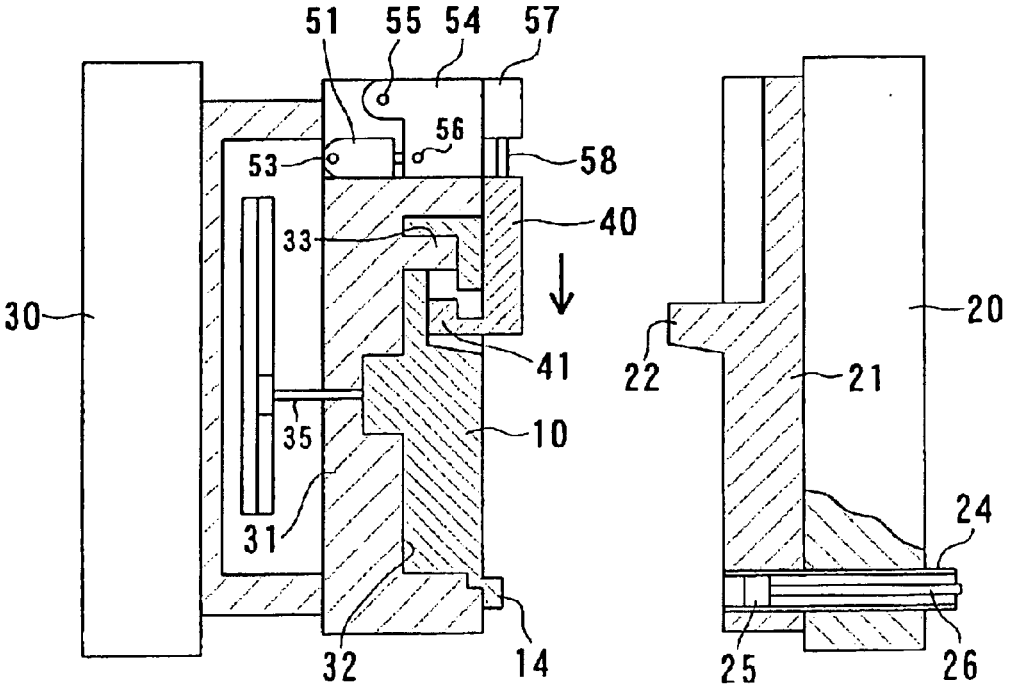
FIG. 4 is a cross-sectional view of the metal die device for casting at the time of sliding movement of the core.

After die opening, the piston rod 58 of the slide cylinder 57 is protruded to permit the movable core 40 to be slid downwards in the plumb line direction, as shown in FIG. 4. By this downward sliding, the undercut forming projection 41 of the core 40 is disengaged from the undercut portion of the cast product 10.

Figure 5:
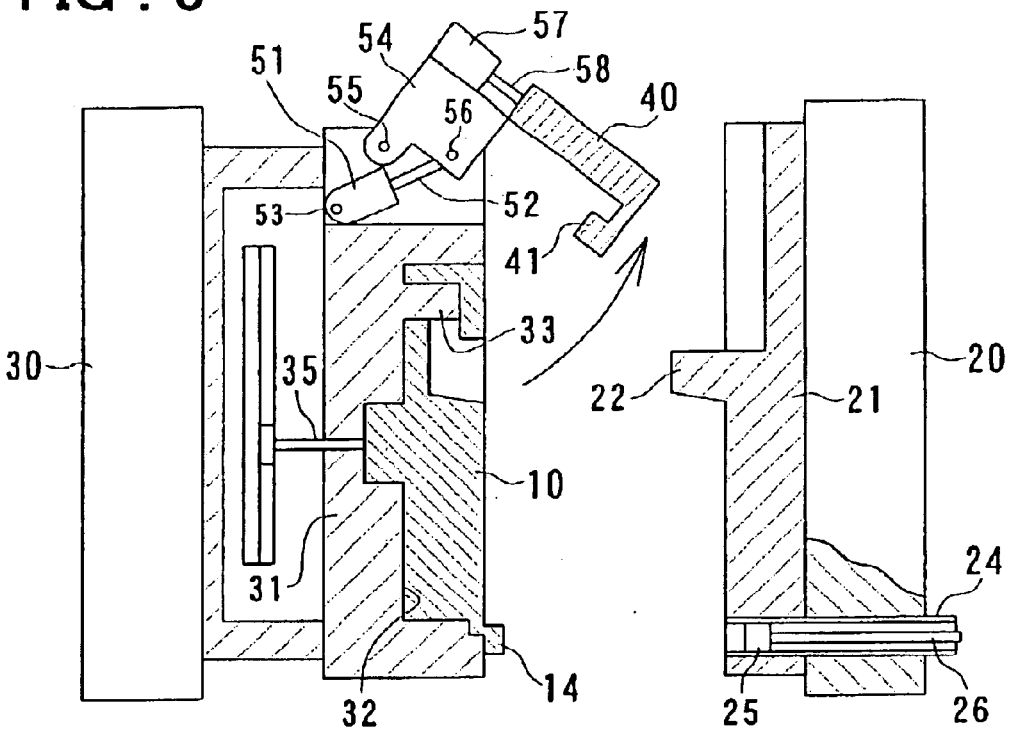
FIG. 5 is a cross-sectional view of the metal die device for casting at the time of swinging movement of the core.

After the downward sliding of the movable core 40, the piston rod 52 of the slide cylinder 51 is protruded, as shown in FIG. 5, whereby the swing member 54 and the slide cylinder 57 are caused to swing counterclockwise about the supporting pin 55 as the center of rotation. By this swinging, the movable core 40 is also caused to swing counterclockwise (as shown by an arrow), and comes receded towards the upper outer side from the space between the dies 21, 31 separated from each other. By the movable core 40 being receded upwards, there is now no obstacle in disengaging the cast product 10 from the casting cavity 32 of the movable die 31 in the horizontal direction.

Figure 6:
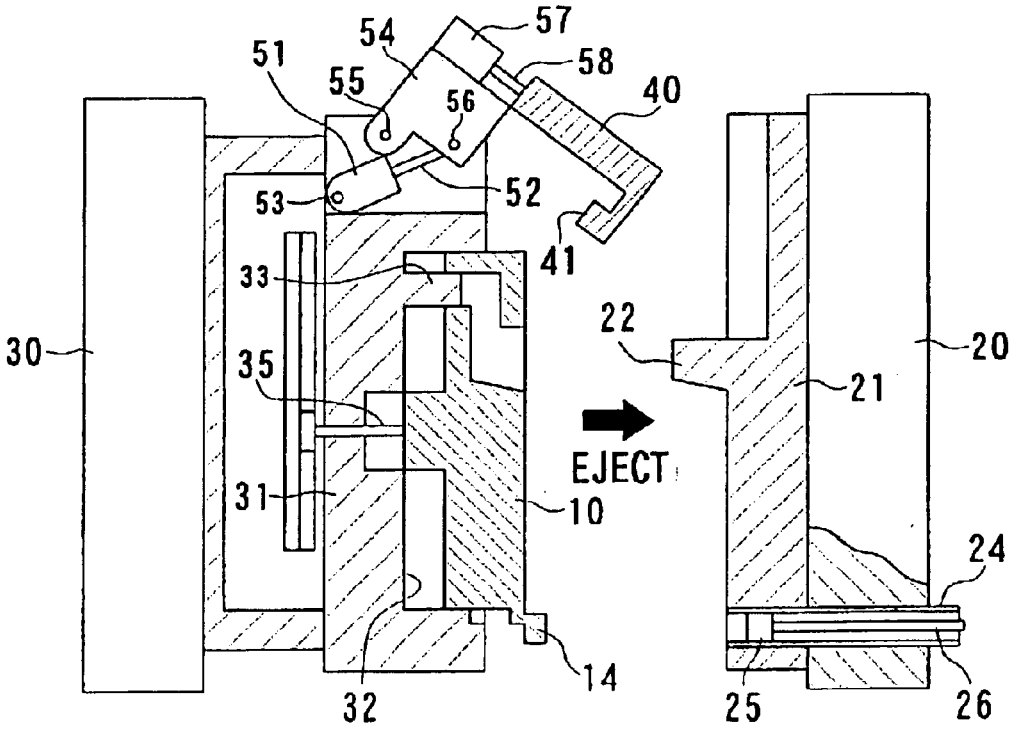
FIG. 6 is a cross-sectional view of the metal die device for casting at the time of ejecting the cast product.
Figure 7:
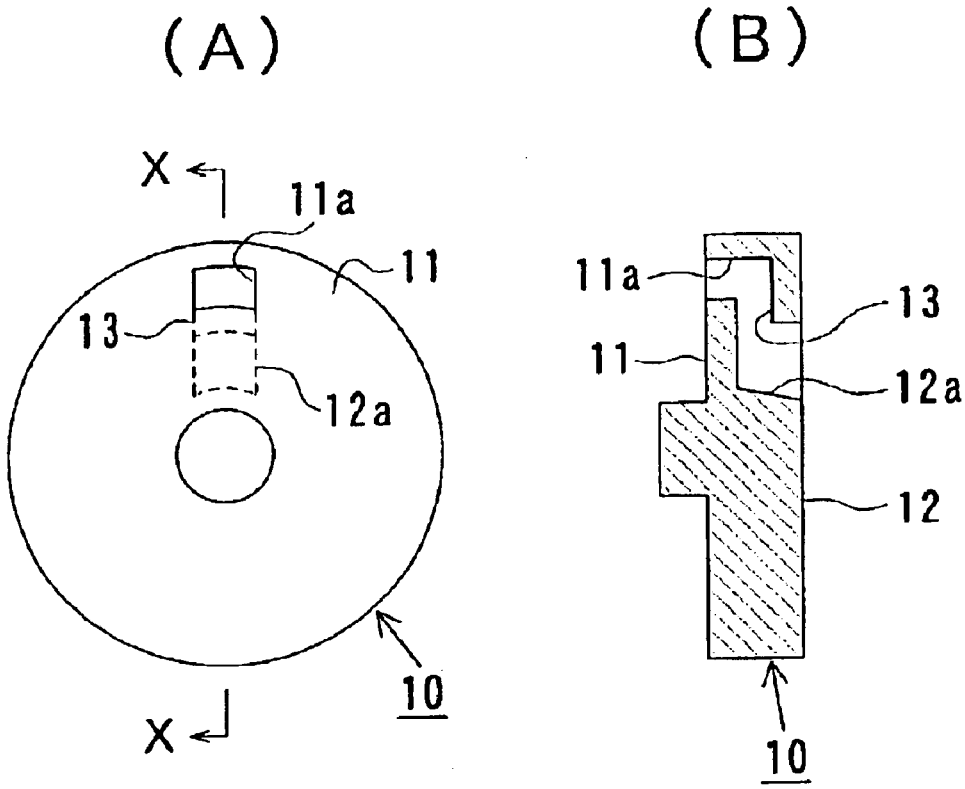
FIGS. 7A and 7B show a typical cast product to be obtained by the metal die device for casting, with FIG. 7A being a plan view of the cast product and FIG. 7B being a cross-sectional view taken along line X—X of FIG. 7A.

After causing the movable core 40 to swing and be receded upwards, an ejection mechanism is actuated, as shown in FIG. 6, to eject the cast product 10 towards the fixed die 21 by the ejection pins 35. This enables the cast product 10 to be released from the casting cavity 32 of the movable die 31. The runner 14 is removed from the cast product 10, taken out from the metal die device, whereby the cast product 10 of a shape as shown in FIGS. 7A and 7B may ultimately be produced.

The following effects may be derived with the present embodiment:

With the use of the present embodiment of the metal die device for casting, the cast product 10 having a desired undercut 13 may directly be prepared by die casting, without using the collapsible core or applying laborious post-processing, including machining the bulk portion for producing the desired undercut, as contrasted with the conventional practice. The result is that the cast product 10 having the desired undercut 13 may be produced at a low cost.

In the present embodiment of the metal die device, the core driving mechanism for causing the movable core 40 to slide and swing is of a simplified structure comprised of the swing cylinder 51, swing member 54 and the slide cylinder 57, provided in the upper area (i.e., marginal area) of the movable die 31. In addition, the movable core 40 and the core driving mechanism are not directly operatively connected to the ejection mechanism, such as ejection pins 35, but are formed as a separate mechanism independent from the ejection mechanism. Thus, the metal die device for die casting, according to the present embodiment, is simpler in structure than the metal die device for die casting as disclosed in the JP Patent Kokai JP-P2000-24769A and hence it becomes possible to reduce the size or production costs of the device.

Figure 3:
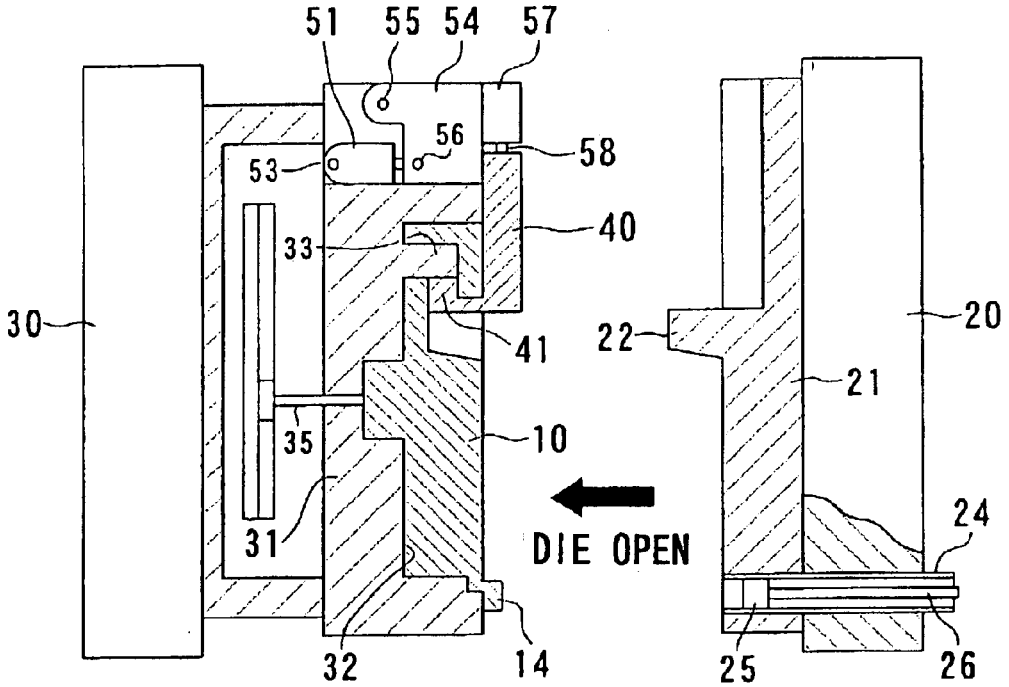
FIG. 3 is a cross-sectional view of the metal die device for casting at the time of die opening.

Moreover, in the present embodiment, in which the cast product 10 is hugged or embraced towards the movable die 31 by the movable core 40, in the die opening, as shown in FIG. 3, there is no fear of the cast product 10 sticking to the fixed die 21. As a consequence, the cast product 10 may be smoothly released from the movable die 31 by the ejection pins 35 of the ejection mechanism provided on the movable die 31. Moreover, since there is no risk of the cast product 10 being stuck to the fixed die 21, such a metal die design is possible in which the recess forming projection 22 is provided on the fixed die 21 for affording the recess 12*a* opening towards the fixed die and the undercut 13 communicating with the recess to the fixed die 21 to thereby increase the die-releasing resistance on the fixed die. Thus, according to the present embodiment, it can be optionally selected in which of the fixed die 21 and the movable die 31 the recess or the opening communicating with the undercut 13 is to be formed, thus increasing the degree of freedom in metal die designing, (Modification)Although the cylinder 51 operating in association with a link mechanism is used in constituting the swinging mechanism for the swing member 54, the swing member 54 may be caused to swing by a mechanical rotation mechanism, such as gearing or a stepping motor. Moreover, although the slide mechanism for the movable core 40 is constituted by the cylinder 57, the movable core 40 may be adapted to be slid using a mechanical slide mechanism comprised of a combination of a rack and a pinion gear.

The meritorious effects of the present invention are summarized as follows.

With the above-described metal die device for casting, according to the present invention, cast products having undercuts may directly be formed using a device of a simpler structure. Additionally, the degree of freedom in metal die designing can be maintained without the casting conditions in the metal die device being excessively restricted by the shape or the position of the undercut in the cast product.

Although not explicitly disclosed as a process invention, the present invention may be naturally comprehended as such, which can be the subject matter without departing from the gist of the present invention as disclosed under a generic concept.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A metal die device for forming a cast product having an undercut, comprising:

first and second dies for being moved towards and away from each other, said dies when closed defining a casting cavity therein;

a core having an undercut forming projection; and a core driving mechanism for sliding the core in a direction substantially perpendicular to a direction of movement of said first and second dies towards and away from each other, and for causing said core to swing towards outside from a position between the first and second dies which are in a state separated from each other;

wherein the metal die device comprises;

a first state at which the undercut forming projection of said core is arranged in said casting space for producing a cast product; and a second state at which said core is caused to slide and swing by said core driving mechanism at the time of opening said first and second dies to disengage said core from the cast product and to enable the cast product to be dismounted from one of said dies.

2. The metal die device as defined in claim 1 wherein said core driving mechanism comprises;

a slide mechanism operatively connected to said core for causing said core to slide in a direction substantially perpendicular to the direction of movement of said first and second dies towards and away from each other; and a swing mechanism operatively connected to said slide mechanism for causing said core and the slide mechanism to swing towards outside from between the first and second dies which are in the state separated from each other.

3. The metal die device as defined in claim 1 wherein said first die is a fixed die, said second die is a movable die, and the movable die as said second die is provided with said core and with said core driving mechanism, and wherein said movable die is provided with an ejection mechanism for ejecting the cast product affixed to said movable die towards said fixed die at the time of die opening for releasing the cast product affixed to said movable die therefrom.

4. The metal die device as defined in claim 3 wherein during casting following die closure and immediately after die opening, said core is located at a position of clamping the cast product between the core and the movable die.

5. The metal die device as defined in claim 3 wherein said fixed die as said first die comprises a recess forming projection for forming in said cast product a recess which opens toward said fixed die and which communicates with said undercut; and wherein when the movable die is separated away from the fixed die, said recess provided to the cast product by said recess forming projection of said fixed die allows for release of the undercut forming projection from the cast product as the core is slid by said core driving mechanism.

6. The metal die device as defined in claim 2 wherein said first die is a fixed die, said second die is a movable die, and the movable die as said second die is provided with said core and with said core driving mechanism, and wherein said movable die is provided with an ejection mechanism for ejecting the cast product affixed to said movable die towards said fixed die at the time of die opening for releasing the cast product affixed to said movable die therefrom.

7. The metal die device as defined in claim 1 wherein during casting following die closure and immediately after die opening, said core is located at a position of clamping the cast product between the core and one of the first and second dies.

8. The metal die device as defined in claim 7 wherein said one of the first and second dies comprises a recess forming projection for forming in said cast product a recess which opens toward the other of the first and second dies and which communicates with said undercut; and wherein when said first and second dies are separated away from each other, said recess provided to the cast product by said recess forming projection of the other of the first and second dies allows for release of the undercut forming projection from the cast product as the core is slid by said core driving mechanism.

9. A metal die device for forming a cast product having an undercut, comprising first and second dies for being moved towards and away from each other, said dies when closed defining a casting cavity therein;

a core having an undercut forming projection; and a core driving mechanism for sliding the core in a direction substantially perpendicular to a direction of movement of said first and second dies towards and away from each other, and for causing said core to swing towards outside from a position between the first and second dies which are in a state separated from each other;

wherein the metal die device comprises;

means for providing a first state at which the undercut forming projection of said core is arranged in said casting space for producing a cast product; and means for providing a second state at which said core is caused to slide and swing by said core driving mechanism at the time of opening said first and second dies to disengage said core from the cast product so as to enable the cast product to be dismounted from one of said dies.

10. The metal die device as defined in claim 9 wherein said core driving mechanism comprises;

means, operatively connected to said core, for sliding said core in a direction substantially perpendicular to the direction of movement of said first and second dies towards and away from each other; and means, operatively connected to said sliding means, for causing said core and the sliding means to swing towards outside from a position between the first and second dies which are in the state separated from each other.

11. The metal die device as defined in claim 9 wherein said first and second dies comprises a fixed die and a movable die, and the one of said first and second dies is provided with said core and with said core driving mechanism, and wherein said one of the first and second dies is provided with means for ejecting the cast product affixed to said one of the first and second dies towards the other of the first and second dies at the time of die opening for releasing the cast product.

12. The metal die device as defined in claim 11 wherein there is provided means for locating said core at a position of clamping the cast product between the core and said one of the first and second dies during casting following die closure and immediately after die opening.

13. The metal die device as defined in claim 11 wherein said first die comprises a recess forming projection for forming in said cast product a recess which opens toward said second die and which communicates with said undercut; and wherein there is provided means for allowing said undercut forming projection to release from the cast product as the core is slid by said core driving mechanism, when the first and second dies are separated away from each other, said recess being provided to the cast product by said recess forming projection of said second die.

14. The metal device as defined in claim 11, wherein said first die comprises a fixed die and said second die comprises a movable die.

15. A metal die device for forming a cast product having an undercut, comprising first and second dies for being moved towards and away from each other, said dies when closed defining a casting cavity therein;

a core having an undercut forming projection; and a core driving mechanism for sliding the core in a direction substantially perpendicular to a direction of relative movement of said first and second dies each other, and for causing said core to swing towards outside from a position between the first and second dies which are in a state separated from each other;

wherein the metal die device comprises;

a first state at which the undercut forming projection of said core is arranged in said casting space for producing a cast product; and a second state at which said core is caused to slide and swing by said core driving mechanism at the time of opening said first and second dies to disengage said core from the cast product and to enable the cast product to be dismounted from one of said first and second dies;

said core driving mechanism comprising;

a slide mechanism operatively connected to said core for causing said core to slide in a direction substantially perpendicular to the direction of the relative movement of said first and second dies for bringing said undercut forming projection of the core from said one of first and second dies to a position just released; and a swing mechanism operatively connected to said slide mechanism for causing said core and the slide mechanism to swing from said just released position towards outside of a core position for casting between the first and second dies in the state separated from each other.

16. The metal die device as defined in claim 15 wherein said first and second dies comprise a fixed die and a movable die, and one of said first and second dies is provided with said core and said core driving mechanism, said one of first and fixed dies being provided with an ejection mechanism for ejecting the cast product affixed to said one of first and second dies towards the other dies of said first and second dies at the time of die opening for releasing the cast product.

17. The metal die device as defined in claim 16 wherein said first die comprises a recess forming projection for forming in said cast product a recess which opens toward said second die and which communicates with said undercut; and wherein when the movable die is separated away from the second die, said recess provided to the cast product by said recess forming projection of said second die allows for release of the undercut forming projection from the cast product as the core is slid by said core driving mechanism.

18. The metal die device as defined in claim 15, wherein said first die comprises a fixed die and said second die comprises a movable die.

* * * * *